United States Patent [19]

Murasaki

[11] Patent Number: 4,959,035

[45] Date of Patent: Sep. 25, 1990

[54] MINIATURE STORAGE CONTAINER FOR A MANUALLY PROPELLED TOY MEMBER

[75] Inventor: Keiichi Murasaki, Tokyo, Japan

[73] Assignee: Sega Enterprises, Ltd., Tokyo, Japan

[21] Appl. No.: 267,036

[22] Filed: Nov. 4, 1988

[30] Foreign Application Priority Data

Mar. 10, 1988 [JP] Japan ..... 63-31988

[51] Int. Cl.[5] ..... A63H 1/04; A63H 17/21; A63H 27/133; A63H 29/00

[52] U.S. Cl. ..... 446/40; 446/75; 446/263; 446/36; 446/429; 446/440

[58] Field of Search ..... 446/75, 429, 430, 440, 446/457, 459, 462, 464, 63–65, 26, 28, 40, 36, 263; 273/86 R

[56] References Cited

U.S. PATENT DOCUMENTS 3,026,642 3/1962 Ryan ..... 446/28 X
4,087,935 5/1978 Edmisson et al. ..... 446/429 X
4,473,969 10/1984 Wilson ..... 446/26
4,690,654 9/1987 DeLaney ..... 446/430 X

FOREIGN PATENT DOCUMENTS 2549382 1/1985 France ..... 446/429
58-86192 6/1983 Japan .

OTHER PUBLICATIONS

"Jet Speed Spinner", Denmark Plastics, Inc., PTO Mar. 1966.

*Primary Examiner*—Mickey Yu
*Attorney, Agent, or Firm*—Price, Gess & Ubell

[57] ABSTRACT

The present invention relates to a toy unit having a movable toy and a flat rectangular toy case having an engaging section disposed therein in which the movable toy is detachably set. Support structure is disposed therein for supporting the movable toy when the movable toy starts movement. The toy case includes a power generating assembly, whereby the toy case has a card shape in the state when the movable toy is set in the engaging section of the toy case.

11 Claims, 18 Drawing Sheets

MINIATURE STORAGE CONTAINER FOR A MANUALLY PROPELLED TOY MEMBER

Background of the Invention

1. Field of the Invention

The present invention relates to a toy unit comprising a movable toy such as a vehicle, an air plane, a top or the like but can be driven by a, power generating assembly.

2. Description of the Prior Art

The prior art has frequently used mechanically-driven toys that can be manually activated by a child to drive a particular toy such as a vehicle.

There has conventionally existed examples of a simulated motor bicycle with a rear wheel driven by a rack belt such a show is Japanese Utility Model No. 58-86192.

In that reference, a motor-bike 01 with a doll 02 riding on it is shown in FIG. 23, and its rear wheel 01*b* serves also as a fly wheel with a pinion gear as an integral portion thereof.

When a separate rack belt 03 is inserted along a side frame 04 as shown in FIG. 23, the teeth of the rack belt 03 is held in mesh with the teeth on the pinion.

When the rack belt 03 is pulled strongly after it has been inserted into the side frame 04 and until the rear end of the rack belt 3 reaches the side frame 04, the rear wheel 1*b*serving also as the fly wheel, rotates at a high speed. Thus, when the motor-bike 01 is placed on a floor, it is propelled by the rotation of the rear wheel 1*b*.

The rack belt 03 is curved to a ring shape after it has been inserted into the side frame 04 to lock the end portion at an extreme end so that the motor-bike 01 can be appropriately held.

In the case of the aforesaid prior art, since one of the user's hands holds the motor-bike 01 itself and the other hand pulls the rack belt 03 vigorously, an excessive force is applied to the body of the motor-bike 01.

Therefore, excessive stress may be exerted on a part of the motor-bike 01 depending on the place where the motor-bike is held or a direction in which the rack belt 03 is pulled, which can cause damage to the motor-bike 01.

The motor-bike. 01 is generally placed on the floor after the rear wheel 01*b* has been rotated; however, the motor-bike 01 may not travel stably and can either fall down at once or lose the rotational force of the rear wheel 01 after only a short distance of traveling, when the position of the motor-bike 01 as it is placed on the floor and the timing of the release by the user's hand are not good.

In addition, although the motor-bike 01 which is conveniently carried by the rack-belt 03 is made into a ring shape after it has been inserted into the side frame 04, there has often been the possibility that the motor-bike 01 strikes against an object or is caught by it because it is in an exposed state.

It is an object of the present invention to provide a toy unit comprising a movable toy on which no excessive force is exerted to thereby permit it to enjoy a stable movement at all times. The toy unit can be engaged with a flat case to form a card shape convenient for carrying.

In other words, the toy unit according to the present invention comprises a movable toy and a flat rectangular toy case having an engaging section disposed therein in which the movable toy is detachably set and support means are disposed therein for supporting the movable toy when the movable toy starts movement. A power generating means is also provided, whereby said toy case makes a card shape when the movable toy is set in the engaging section of toy case.

Since the toy case is provided with the support means, and the movable toy is supported by the support means and powered by the power generating means to start movement, effective power is applied to the movable toy and there is no possibility that the movable toy is damaged by an unnatural force exerted thereon.

Since the movable toy starts movement from a state that it is supported by the toy case, it can move stably at all times.

Further, since the movable toy is engaged with the toy case to form a card shape as a whole, it is conveniently carried and since there are no projections thereon, it is solidly protected without being caught by an object.

Detailed Description of the Preferred Embodiments

A first embodiment according to the present invention will be described below with reference to FIG. 1–FIG. 11.

Figure 1:
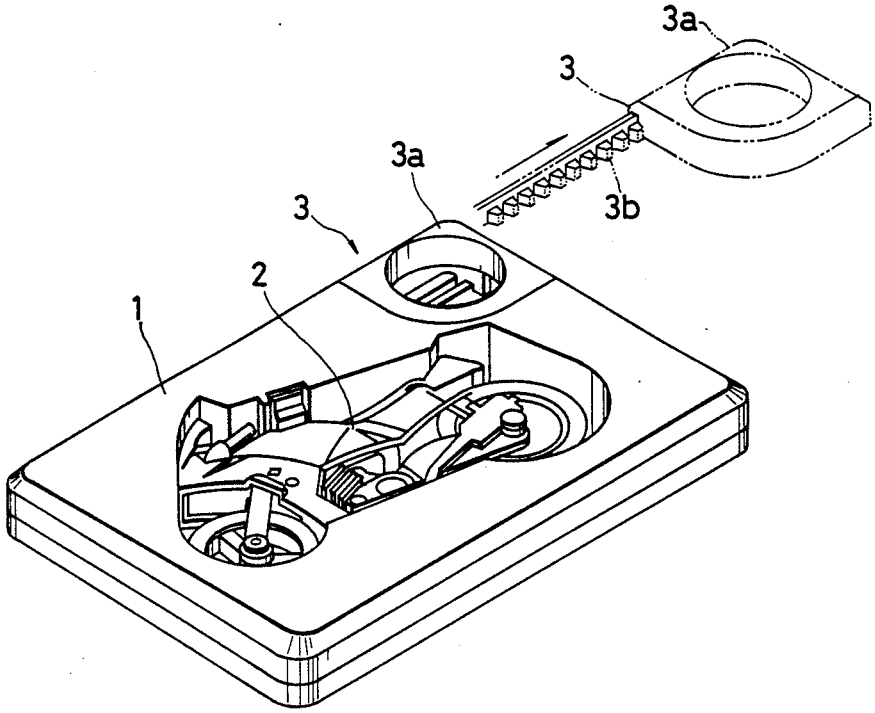
FIG. 1 is an overall perspective view of a toy motor-bike of a first embodiment according to the present invention.

The first embodiment provides a toy motor-bike unit comprising a motor-bike as a movable toy. FIG. 1 is a perspective view illustrative of the state of the toy motor-bike 2 set into a card case 1 as a card-shaped toy case with a power rack 3 as a power generating device engaged therewith.

The card case 1 is as large as a name card having a size of 6 cm long, 9 cm wide and 1.2 cm thick, which is of a size and configuration to be held in a user's palm. The card case 1 is such that the toy motor-bike 2 and the power rack 3 is completely accommodated in it with no parts projecting therefrom to facilitate carrying. The toy motor-bike 2 set into the card case 1 can be easily removed and the power rack 3 can also be removed easily by being pulled out in the direction indicated by an arrow (refer to two-dot-and-dash line in FIG. 1).

Figure 2:
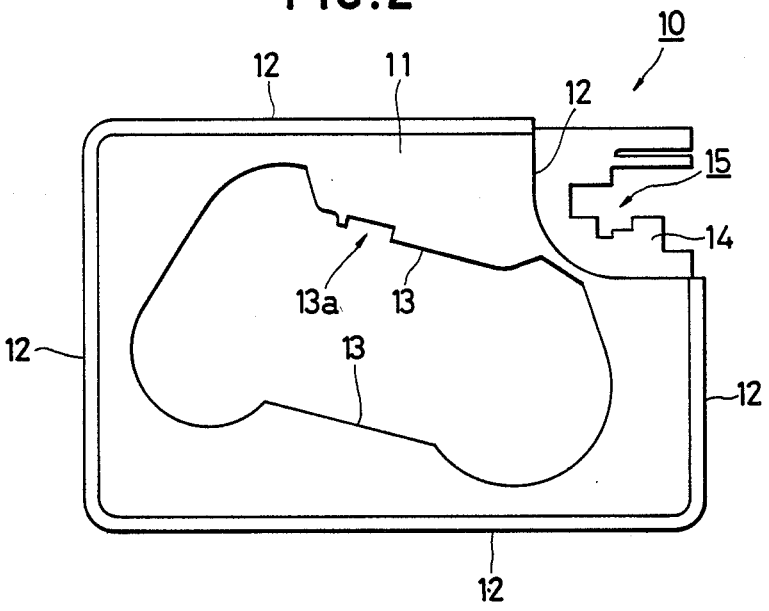
FIG. 2 is a diagram of the outside surface of an upper case of a card case for the toy motor-bike.
Figure 3:
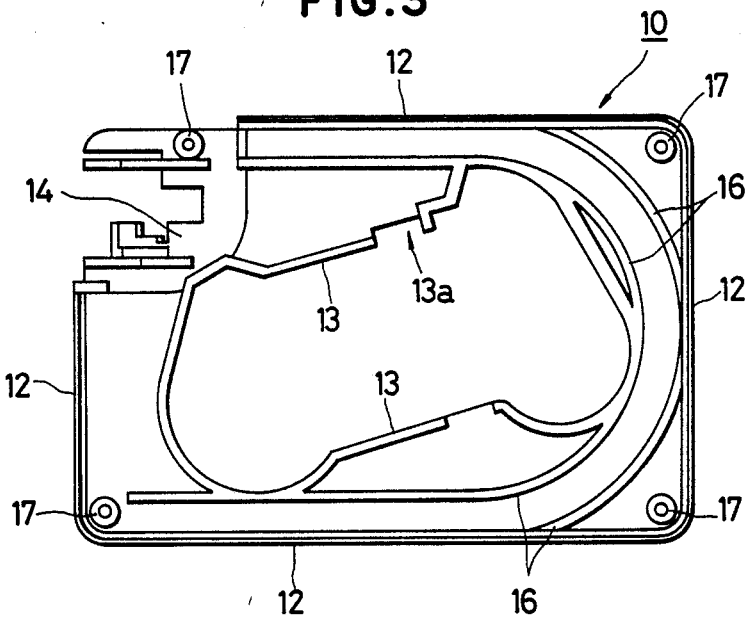
FIG. 3 is a diagram of the inside surface of the upper case.
Figure 4:
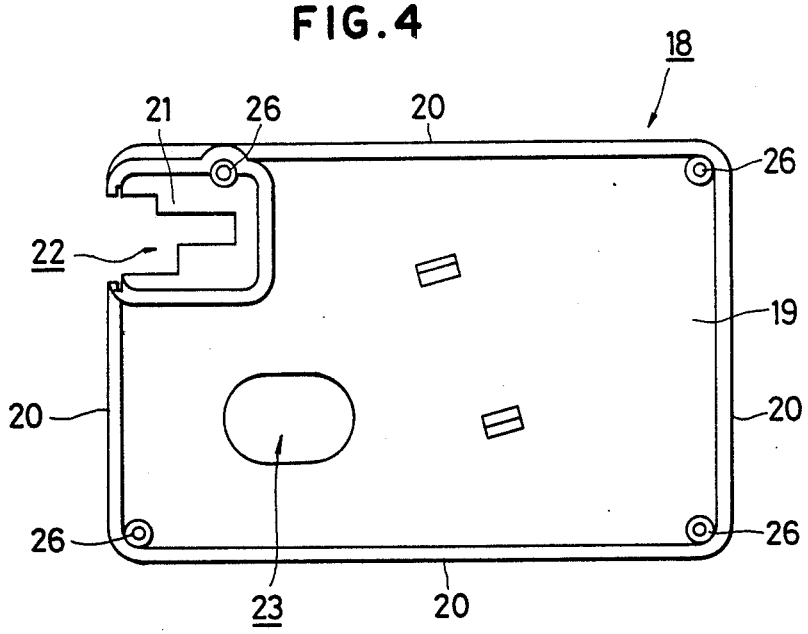
FIG. 4 is a diagram of the outside surface of a lower case of the card case.
Figure 5:
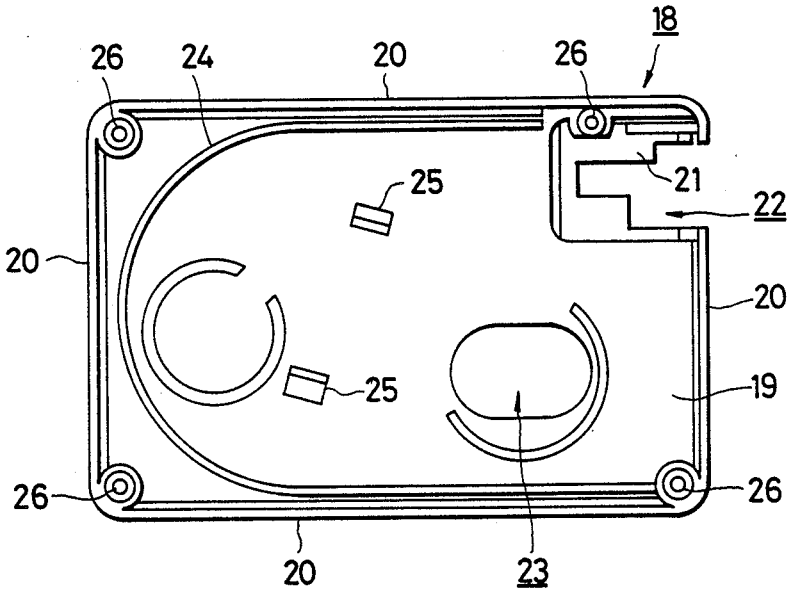
FIG. 5 is a diagram of the inside surface of the lower case.

The card case 1 comprises an upper case and a lower case divided into two portions. FIGS. 2 and 3 show diagrams of the outside surface and the inside surface of the upper case 10 and FIGS. 4 and 5 show diagrams of the outside surface and the inside surface of the lower case 18.

The upper case 10 is of a box shape having a tapered side wall 12 along the four sides of an upper wall 11 and a large partition 13 substantially profiling the toy motor-bike and standing in the upper wall 11 at the center thereof.

The side walls 12 are depressed inwardly to have a shape along a holding portion 3*a* of the power rack 3 at the upper right corner of the upper case 10, a substantially U-shaped support wall 14 is defined below the depressed portion and one side thereof is opened.

A cutout 15 is defined at a portion which is positioned a little inward of the opening of the support wall 14.

As shown in FIG. 3, two guide walls 16 are defined around the partition 13 on the inside surface of the upper case 10. The guide walls 16 are disposed from the support wall 14 around the partition 13 along three tapered side walls 12 with its corner portion curved to provide an arc shape.

Four cylindrical screw holes 17 are defined through three corners and the support wall 14 in the inside wall.

Figure 11:
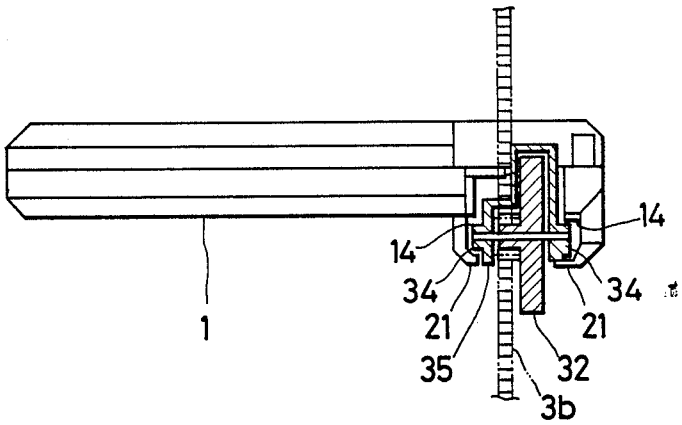
FIG. 11 is a front view of the case, partly in cross section.

On the other hand, the lower case 18 has a tapered side wall 20 defined along the four sides of a bottom wall 19 and a U-shaped support wall 21 defined at the corner corresponding to the support wall 14 of the upper case 10 as shown in FIG. 11, the support wall being a little expanded from a surface and confronting with the support wall 14. The lower case 18 also has a cutout 22 directed from a location a little nearer to an opening as compared with the location of the support wall 21 to which the cutout 15 defined in the support wall 14 corresponds toward the opening.

A hole 23 is defined through the bottom wall 19 at a location a little dislocated to a lower left direction from the center of the bottom wall 19.

A projection 24 is defined on the inside wall of the lower case 18 in correspondence with the two guide walls 16 of the upper case 10 in such a manner that it is interposed therebetween and a pair of holding pieces 25 stand at the center of the inside surface in substantial alignment.

Round holes 26 are defined in correspondence with the screw holes 17.

Figure 6:
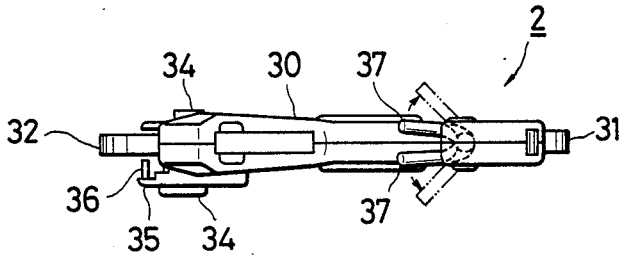
FIG. 6 is a top view of the toy motor-bike.
Figure 7:
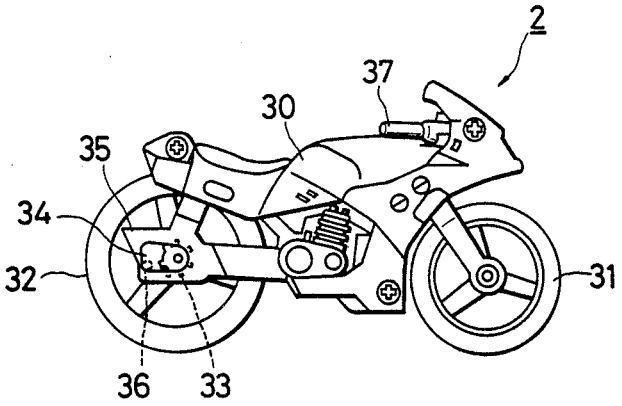
FIG. 7 is a side view of the toy motor-bike.

As shown in FIGS. 6 and 7, the toy motor-bike 2 has a front wheel 31 and a rear wheel 32 pivotally supported at the front and the back of a flat body 30, a pinion gear 33 is integrally disposed at the right side surface of the rear wheel 32 and a shaft passing through the rear wheel 32 and the pinion gear 33 is supported by bearing members 34 at opposite sides.

In addition, a vertical width of the bearing members 34 in FIG. 7 is substantially equal to the width between the support walls 14 and 21 conference with the distances between the upper case 10 and the lower case 18 when the upper case 10 is placed over the lower case 18, as shown in FIG. 11.

A support bar 36 projecting inwardly is disposed at the rear end of the inside surface of a side frame 35 for supporting the bearing member 34 on the right side to support the power rack 3 to be meshed with the pinion 33.

Right and left handles 37 supported by the body 30 at their base ends can be opened and closed as shown in FIG. 6.

As shown in FIG. 1, the rack 3 comprises the flat and rectangular holding portion 3*a* with a round hole defined at the center and a long rack belt 3*b* extending from the holding portion 3*a*, the rack belt 3*b* being flexible and having teeth defined on its one side.

Figure 8:
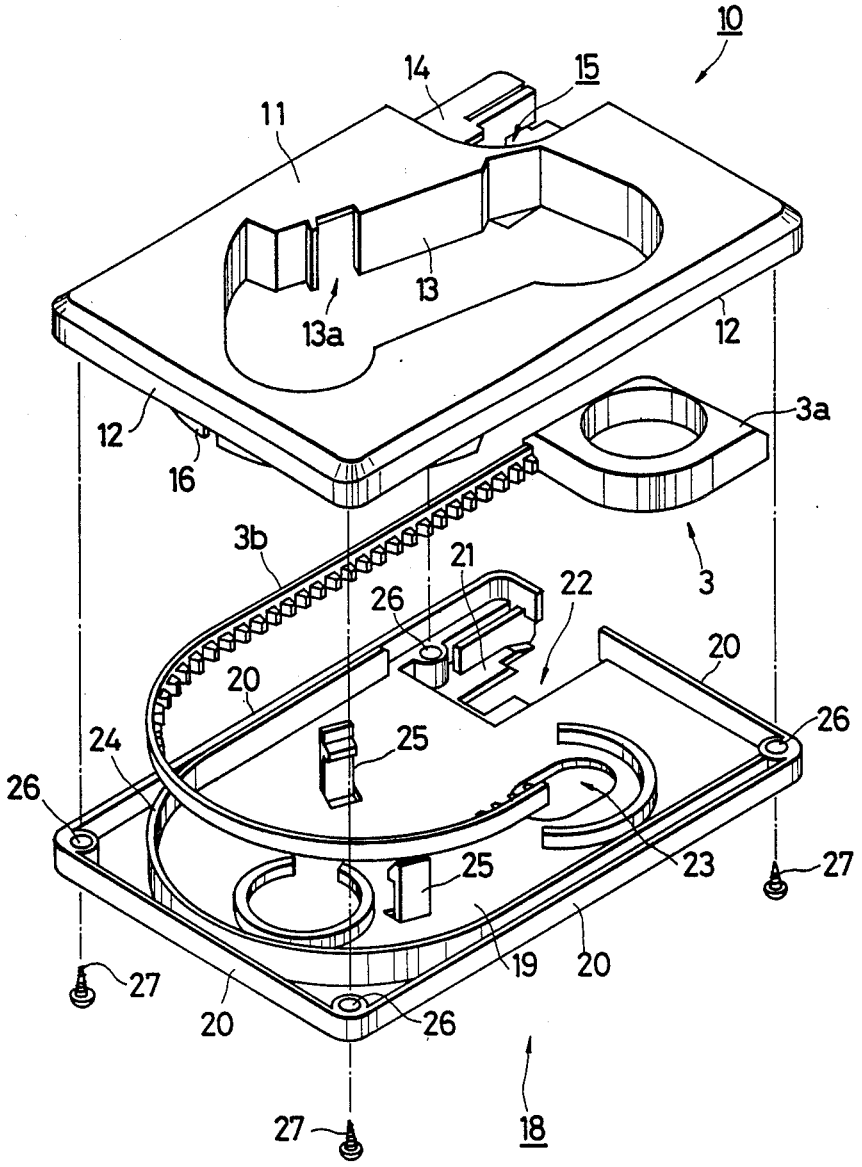
FIG. 8 is an exploded perspective view of the card case.

FIG. 8 is an exploded perspective view of the card case comprising the aforesaid members, wherein when the upper case 10 is placed over the lower case 18 and screws are passed through the round holes 26 and the screw holes 17 from the lower side for threading, the lower projection 24 is engaged to extend between the two upper guide walls 16 to form a guide pipe as well as the partition 13 of the upper case 10 and the bottom wall 19 of the lower case 18 form an engaging section into which the toy motor-bike 2 is set. The holding pieces 25 stand in the engaging portion in the state that they are set into the cutouts 13*a* of the partition 13.

The upper and lower substantially U-shaped support walls 14, 21 confronting each other form a setting portion with one side opened and the upper portion of the upper support wall 14 is cut out to permit the holding portion 3a of the rack 3 to be set thereinto.

Therefore, the toy motor-bike 2 is set into the engaging section surrounded by the partition 13 and the body 30 is gripped by a pair of the holding pieces 25.

When the rack belt 3*b* of the rack 3 is inserted into the guide pipe formed by the guide walls 16 and the projection 24 from the side of the support wall 14, the rack belt 3*b* goes on along the guide pipe, and when the holding portion 3*a* is engaged with the cutout on the support 14 finally, a piece of card is formed as shown in FIG. 1.

The toy motor-bike 2 can be taken out from the card case 1 by pushing out the toy motor-bike 2 with a finger applied to the hole 23 defined through the bottom wall 19 of the lower case 18, and the power rack 3 can be pulled out as it is by holding the holding portion 3*a* in the direction shown by the arrow, as shown in FIG. 1.

Figure 9:
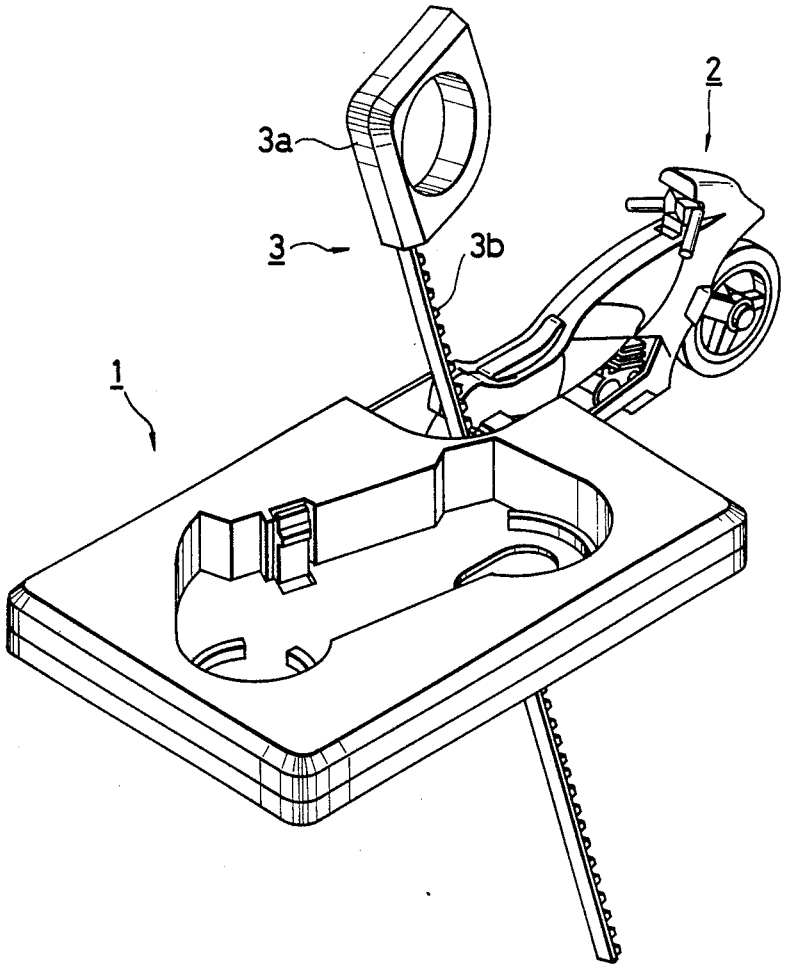
FIG. 9 is a perspective view illustrative of a state of the toy motor-bike supported by the card case with a power rack inserted therethrough.

As shown in FIG. 9, when the toy motor-bike 2 thus taken out is placed vertically on the card case 1 and the rear wheel 32 is inserted into the support walls 14, 21 through their openings, the bearing members 34 on the right and left sides of the rear wheel 32 are inserted between the upper and lower support walls 14, 21 so that the body 30 is supported by the card case 1 through the bearing members 34 (refer to FIG. 11).

Figure 10:
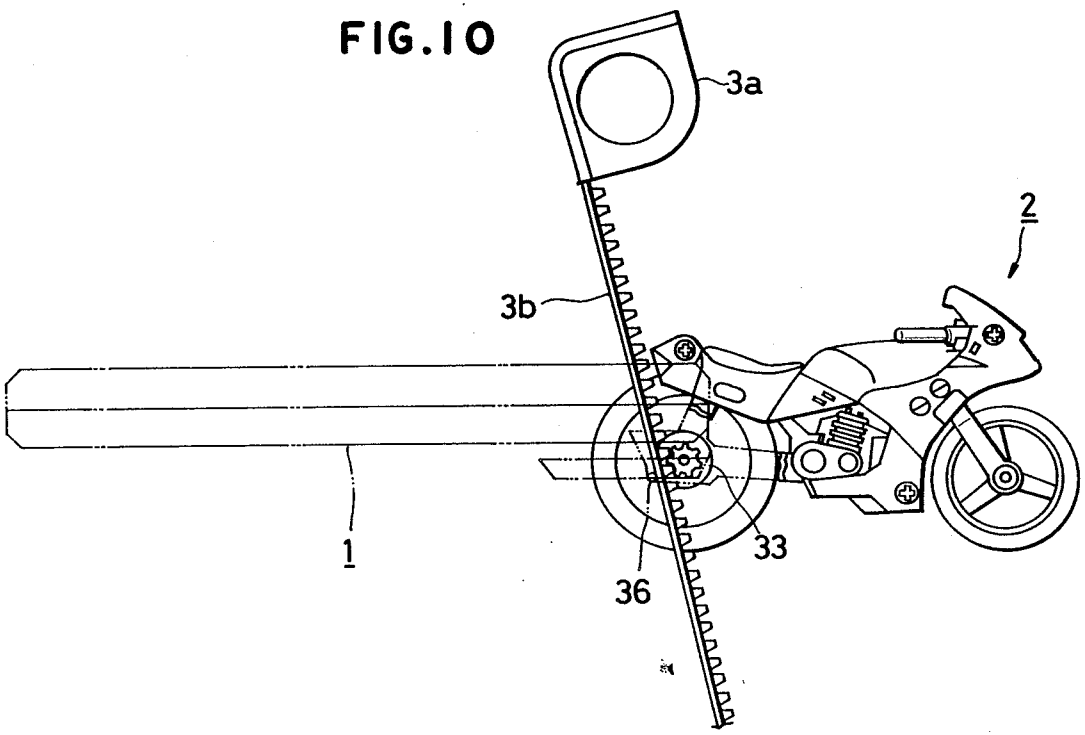
FIG. 10 is a side view of the toy motor bike with the case shown a partly in cross section.

When the extreme end of the rack belt 3*b* of the power rack 3 is inserted and passed through the cutout 15 defined in the support wall 14 and the cutout 22 defined in the support wall 21 from the upper side, a flat side of the rack belt 3*b* is supported by the support bar 36 projecting from the side frame 35 of the toy motor-bike 2 and the teeth of the rack formed on the other side of the rack belt 3*b*, is meshed with the pinion gear 33 integrally disposed at the rear wheel (refer to FIGS. 9–11).

Thus, the power rack 3 is inserted in the vicinity of the holding portion 3*a*, the card case 1 is held by one hand and the rear wheel 32 is positioned adjacent a floor to complete the preparation for a start. Next, when the grip portion 3*a* of the power rack 3 is held by another hand and pulled vigorously in a direction obliquely upwardly, the rear wheel 32 serving also as a fly wheel is rotated at a high speed through the rack and the pinion gear 33.

When the rear wheel 32 is brought into contact with the floor surface at a suitable time, the toy motor-bike 2 starts traveling.

With such a toy motor-bike 2, power is applied thereto by pulling the power rack 3 in the state that the toy motor-bike 2 is held by the card case 1 without being held directly and the card case 1 is held by one hand so that the power is effectively applied to the motor-bike 2 and no unnatural power is applied thereto to prevent damage.

Further, since the toy motor-bike 2 is made to start in the state that it is held by the card case 1, it can start stably at all times and its traveling direction can be set fairly accurately.

Furthermore, since the card case 1 accommodating the toy motor-bike 2 and the power rack 3 makes a card shape, which is convenient for carrying and since there are almost no projected portions on the card case 1 cannot be it caught by an object and even if the card case 1 is dropped, it protects the toy motor-bike 2 from being damaged.

Next, a second embodiment will be described with reference to FIGS. 12–14.

The second embodiment provides a toy helicopter unit. FIG. 12 shows a view wherein a toy helicopter 41 is set into a card case 41 as large as the aforesaid card case 1 and a power rack 42 is slightly pulled out.

The card case 41 is easily held by hand and since it has no projections, there is no possibility that it can be caught and damaged by an object.

Figure 12:
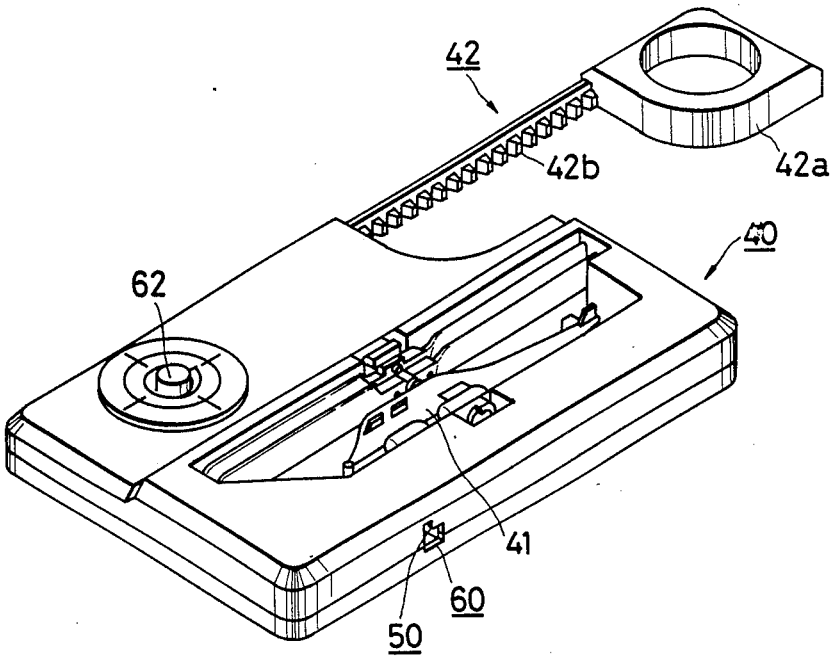
FIG. 12 is an overall perspective view of a toy helicopter unit of a second embodiment.

The power rack 42 comprises a holding portion 42*a* with a round hole at its center and a rack belt 42*b* extending therefrom, the rack belt 42*b* having the teeth of a rack on its one side and the teeth being arranged along the lower side edge of the rack belt 42*b* in FIG. 12.

Figure 13:
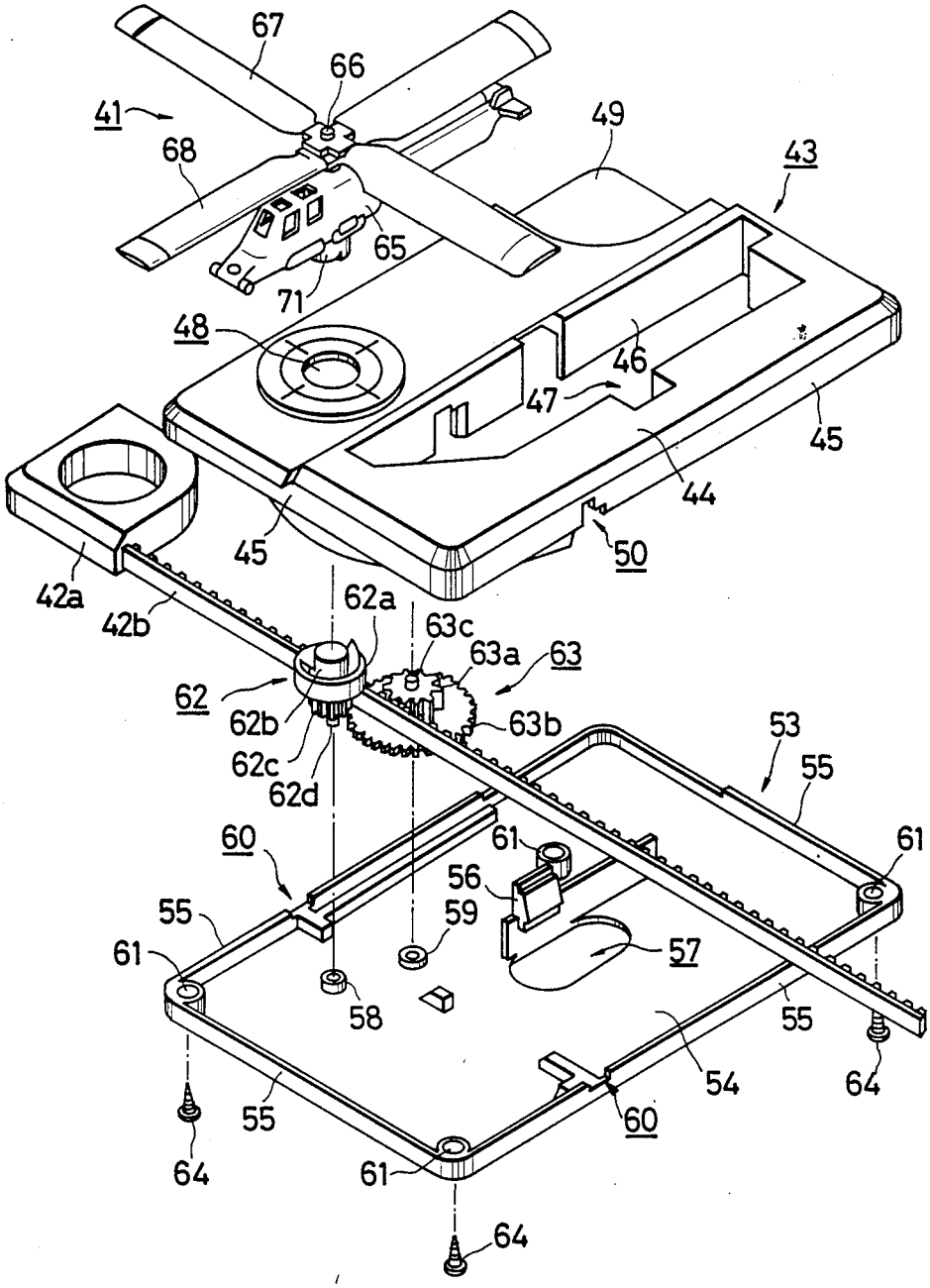
FIG. 13 is an exploded perspective view of the unit.

As shown in FIG. 13, the card case 40 comprises an upper case 43 and a lower case 53 divided into two portions, the upper case 43 is of a box shape having side walls 45 along the four sides of an upper wall 44 and the side of the upper wall 44 with which the toy helicopter is engaged is a little expanded upwardly.

A large oblong partition 46 substantially profiling the toy helicopter 41 stands in the inside of the expanded upper wall.

A cutout 47 is defined at a part of the partition 46 with which a rotor shaft of the toy helicopter 41 is engaged.

The upper case 43 has a round hole 48 in the vicinity of its lower left corner. The side wall 45 is depressed inwardly to a shape along the holding portion 42*a* of the power rack 42 at the upper right corner of the upper case 43. A support wall is defined below the depressed portion which has a shape identical with a flat shape of the holding portion 42*a* of the power rack 42.

The long confronting side walls 45 have L-shaped cutouts defined at prescribed confronting locations, respectively.

Further, a non-illustrated guide wall, which is identical with that shown in the aforesaid embodiment, stands on the inside surface of the upper case 43 from the side of the support wall 49 along the three side walls 45 and four screw holes are defined at the three corners of the upper case 43 and at the side of the support wall 49.

Next, the lower case 53 has side walls 55 along the four sides of the bottom wall 54, a holding piece 56 stands at a location a little displaced from the center of the bottom wall 54 and a hole 57 is defined in front of it.

Cylindrical bearings 58, 59 are defined in the vicinity of the upper left corner of the bottom wall 54.

Cutouts 60 corresponding to the cutouts 50 in the side walls 45 of the upper case 43 are defined in the confronting long side walls 55.

Four cylindrical holes 61 are defined in the three corners of the inside surface of the bottom wall 54 and in the vicinity of the holding piece 56, respectively.

A pair of rotary members 62, 63, of which support shafts are inserted into the bearings 48, 59 to be pivotally supported, are accommodated in the card case 40.

The rotary member 62 on one side comprises a column section 62*a* at the center, a cylindrical engaging section 62*b* formed on the column section 62*a* and having a circumferential edge portion cut out and a diameter smaller than that of the column section 62*a* and a gear 62*c* of a smaller diameter having a shaft 62*d* projecting from the lower surface thereof, these three elements being formed integrally.

The shaft 62*d* at the lower part of the rotary member 62 is inserted into the bearing 58 and the engaging section 62*b* at the upper part thereof is engaged with the round hole 48 so that the rotary member 62 is pivotally held.

The rotary member 63 on the other side comprises a pinion gear 63*a* of a smaller diameter and a flat gear 63*b* of a larger diameter disposed up and down, and shafts 63*c* projecting from the upper and lower surfaces thereof, the pinion gear 63*a* and the flat gear 63*b* being formed integrally. The lower shaft 63*c* is inserted into the aforesaid bearing 59 and the upper shaft 63 is inserted into a non-illustrated bearing disposed on the inner surface of the upper case 43 to be pivotally held.

When both the rotary members 62, 63 are disposed at prescribed locations, the lower half of the gear 62*c* of the rotary member 62 is meshed with the gear 63*b* of the rotary member 63 and a small clearance is provided between the upper half of the gear 62*c* of the rotary member 62 and the pinion gear 63*a* of the rotary member 63.

The rack belt 42*b* of the power rack 42 passes through the clearance to permit the teeth of the rack to be meshed with the pinion gear 63*a* of the rotary member 63.

At that the rack belt 42b comes in through one side of the cutouts 50, 60 defined to the confronting side walls of the upper and lower cases and comes out through the other side thereof.

Since the teeth formed on one side of the rack belt 42b are arranged along the lower side edge in FIG. 13 and the corresponding cutout 50 is of an L-shape, the rack belt 42b cannot be inserted into the cutouts 50, 60, unless it is inserted thereto from the direction and with the posture shown in FIG. 13.

With the above arrangement, the power rack is prevented from being operated in error.

Thus, the card case 40 is assembled by having the upper case 43 placed over the lower case 53 with the rotary members 62, 63 disposed at prescribed locations of the lower case 53 and screws 64 are inserted from the lower side through the cylindrical holes 61 and into screw holes in the upper case 43 (not shown).

In the instance, the engaging section 62b of the rotary member 62 is fitted to the round hole 48 of the upper case 43.

Next, as shown in the upper portion of FIG. 13, the toy helicopter 41 comprises a flying body 65 formed in a flat configuration a shaft 66 passes through the flying body 65 vertically to be pivotally held, a cylindrical engaging member 71 having a lower edge portion cut out to a waveform is attached to the lower end of the shaft 66 and two rotors 67 and 68 are piled up and mounted on the upper end of the shaft 66 with their centers held by the shaft 66.

The upper rotor 67 is integrally secured to the upper end of the shaft 66 and the lower rotor 68 is pivotally supported by the shaft 66 so that a position of relative rotation of the lower rotor 68 can be changed with respect to the upper rotor 67.

Figure 14:
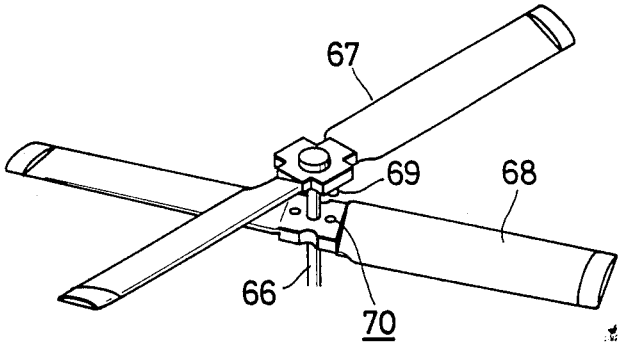
FIG. 14 is a perspective view illustrative of a combination of rotors of the helicopter.

As shown in FIG. 14, a projection 69 is disposed on the lower surface of the upper rotor in the vicinity of the shaft 66 and a small hole 70 is defined through a prescribed location of the upper surface of the lower rotor 68. When both the rotors 67, 68 are turned relatively to cause the projection 69 to be locked to the small hole 70, both the rotors 67, 68 forms a cross configuration and are integrally secured to the shaft 66.

When the toy helicopter 41 is to be flown, the rotors 67, 68 are used in a form that they are crossed as described above and when it is housed in the card case 40, the cross is dissolved, and the directions of both the rotors 67, 68 are aligned with each other and both the rotors 67, 68 are piled up to be parallel with the longitudinal direction of the flying body 65 so that the overall toy helicopter 41 is made flat to be housed in the card case 40 without any projecting parts as shown in FIG. 12.

When the toy helicopter 41 is housed, the holding piece 56 of the lower case 53 engaged with the cutout 47 of the upper case 43 presses the shaft 66 of the toy helicopter 41 so that the toy helicopter 41 can be gripped between the holding piece 56 and the confronting partition 46.

When the toy helicopter 41 is to be flown in the state that the toy helicopter 41 and the power rack 42 is housed in the card case 40, the power rack 42 is pulled out from the card case 40 first, the toy helicopter 41 is pushed out with a finger applied to a hole 57 defined through the bottom wall 54 and then the rotors 67, 68 of the toy helicopter 41 are combined to form the cross.

Then, when the extreme end of the rack belt 42b of the rack 42 is inserted into the holes of the cutouts 50, 60 defined to the prescribed side walls 45, 55, the rack belt 42b is inserted while it is meshed with the pinion gear 63a of the rotary member 63 and comes out from the cutouts 50, 60 defined to the side walls 45, 55 so that the rack belt 42b passes through the card case 40.

The toy helicopter 41 is set to complete the preparation for flying in such a manner that the engaging member 71 disposed on the lower end of the shaft 66 of the toy helicopter 41 is engaged with the engaging section 62b of the rotary member 62 fitted to the round hole 48 of the upper case 43 in the state that the rack belt 42b is inserted into the case 40 until the holding portion 42a of the power rack 42 reaches the vicinity of the card case 40.

When the card case 40 is held by one hand and the power rack 42 is pulled out vigorously by another hand, the rack belt 42b is meshed with the pinion gear 63a to cause the rotary member 63 to rotate and the rotary member 63 rotates the rotary member 62 through the engagement of the gear 63b and gear 62c so that the engagement member 71 fitted to the engaging section 62b is rotated integrally with the shaft 66 and the rotors 67, 68.

The rotation of the rotors 67, 68 permits the toy helicopter 41 to take off upwardly.

Like the aforesaid embodiment, since power is applied to the toy helicopter 42 by the rack 41 passing through the card case 40 and being pulled in the state that the toy helicopter 41 is supported by the card case 40, no unnatural power is applied to the toy helicopter 41 itself and only effective power is applied thereto so that it can start taking off in a stable condition at all times.

Next, a third embodiment will be described with reference to FIGS. 15–17.

The third embodiment provides a top unit comprising a top as a movable toy. A card case, which is also substantially as large as that of the aforesaid embodiment, accommodates three tops and a power rack 82 which is as large as that of the aforesaid embodiment.

Figure 16:
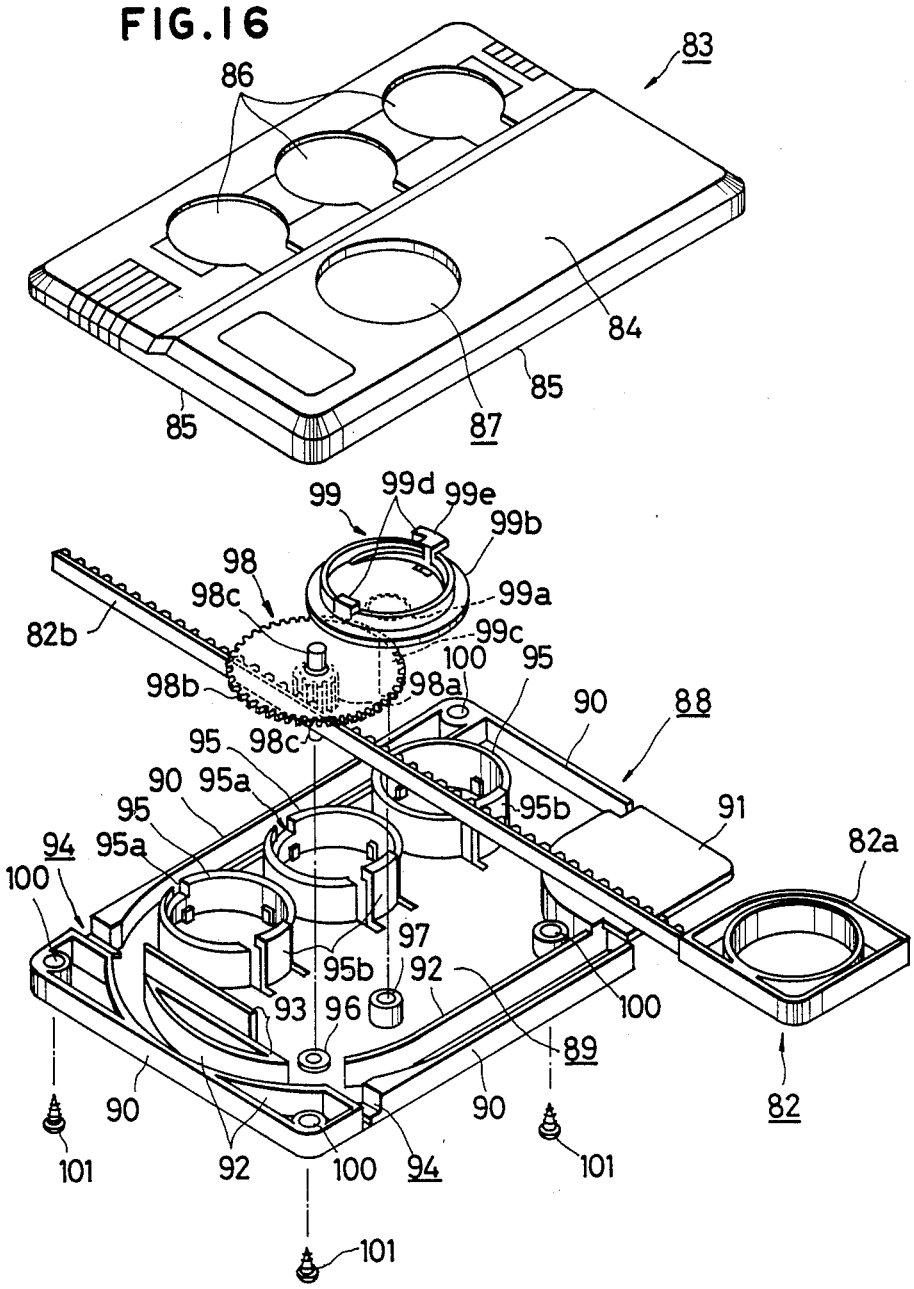
FIG. 16 is a exploded perspective view of a card case of the toy top unit.

As shown in FIG. 16, the card case 80 comprises an upper case 83 and a lower case 88 and the upper case 83 has side walls 85 along the four sides of an upper wall 84, three round holes 86 of the same diameter are defined along the side walls 85 on one side and a round hole 87 of a little larger diameter is defined on the other side of the side wall 85.

The lower case 88 has side walls 90 along the four sides of a bottom wall 89 and a corner of the side walls is depressed inwardly to form a support wall 91 above it.

Like the aforesaid embodiment, guide walls 92 are formed from the side of the support wall 91 along three side walls 85 and have curved corner portions.

A second guide wall 93 is formed such that it passes through the curved portions of the guide walls 92 and is positioned nearer to the shorter side wall 90 on one side in parallel with it and L-shaped cutouts 94 are defined at portions of the longer confronting side walls 90 which are positioned at the extension of the guide wall 93.

Three round holes are defined at locations nearer to the longer side wall 90 on one side and cylindrical holding members 95 are formed at locations inwardly of the circumferential edges of the round holes, the cylindrical holding members 95 being positioned at the locations coincident with the round holes 86 of the upper case 83.

The respective cylindrical holding members 95 have upper edge sections provided with cutouts 95a defined at parts thereof. Two slits are positioned in the cylindrical circumferential wall corresponding with the cutout 95a to define a holding piece 95b. The upper end of the holding piece 95b is a little higher than the upper edge of the cylindrical holding member 95 and the upper end has a projection defined at the center side thereof.

Two bearings 96, 97 are disposed on the bottom wall 89 at locations nearer to the guide wall 93 and the bearing 97 on one side is positioned at the location corresponding to the round hole 87 of the aforesaid upper case 83.

A pair of rotary members 98, 99 of which support shafts are inserted into the bearings 96, 97 to be pivotally supported, are housed in the card case 80.

The rotary member 98 on one side comprises a pinion gear 98a of a smaller diameter, a gear 98b of a larger diameter mounted on the pinion gear 98a and integrally formed therewith and shafts 98c projecting from the upper side of the gear 98b and the lower side of the pinion gear 98a. The lower shaft 98c is inserted into the bearing 96 and the upper shaft 98c is inserted into a non-illustrated bearing disposed in confrontation with the upper case 83 to be pivotally held.

The rotary member 99 on the other side comprises a gear 99a of a smaller diameter, a disk of a larger diameter mounted on the gear 99a and a grip portion 99b composed of a cylinder of a lower height and mounted on the disk, which are integrally formed, the gear 99a having a shaft 99c projecting from the lower side thereof.

Pawls 99 projecting toward the center in diametrical alignment are formed on the upper cylindrical edge section of the grip portion 99b and a stopper 99e is provided with one of the pawls 99d which slightly projects in the centrifugal direction.

The shaft 99c on the lower surface of the rotary member 99 is inserted into the bearing 97 and the cylindrical section of the upper grip portion 99b is engaged with the round hole 87 of the upper case 83 so that the rotary member 99 is pivotally held.

When both the rotary members 98, 99 are disposed at prescribed locations, the gear 98b of the rotary member 98 is meshed with the gear 99a of the rotary member 99 and the the pinion gear 98a is at a location in contact with an extended line of the guide wall 93.

Cylindrical holes 100 are defined at the three corners of the lower case 88 and at the side of the support wall 91 and screw holes (not shown) are defined at the corresponding locations of the upper case 83.

Thus, the card case 80 is assembled with the rotary members 98, 99 disposed at prescribed locations of the lower cases 88, the upper case 83 is placed over the lower case 88 and screws 101 are inserted from the lower side through the cylindrical holes 100 and into screw holes having threads.

Figure 15:
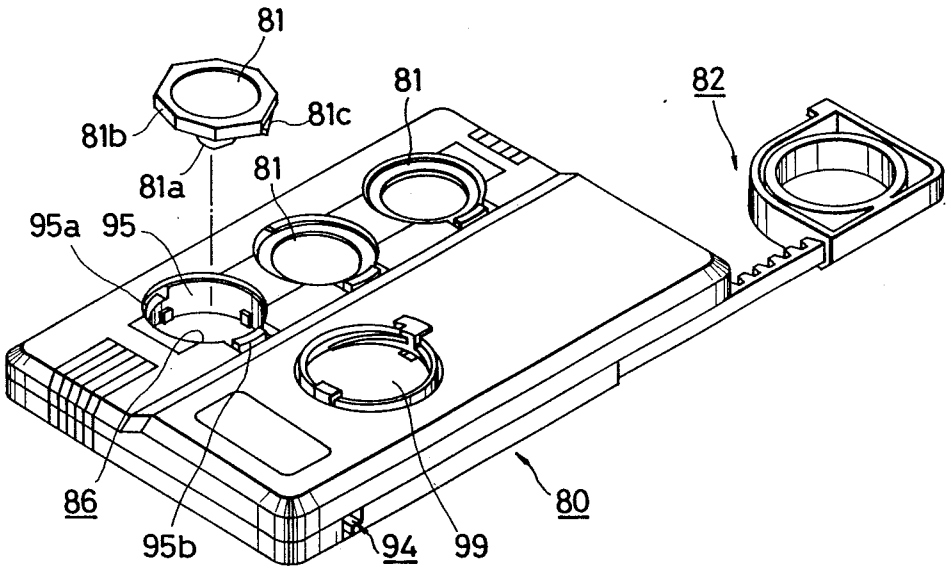
FIG. 15 is an overall perspective view of a toy top of a third embodiment.

As shown in FIG. 15, the grip portion 99b of the rotary member 99 is engaged with the round hole 87 of the upper case 83 and the three cylindrical holding members are coincident with the round holes 86 of the upper case 83 so that the round holes 86 are passed through.

The top 81 corresponds to a so called flat-shaped top, which, as shown in FIG. 15, comprises a conical portion 81a with a shallow bottom and a flat octagonal column portion 81b with two pawls 81c projecting from the outer surface thereof at symmetrical locations.

Each of the cylindrical holding members 95 accommodates each one of the tops 81. As shown in FIG. 15, when the top 81 is accommodated, one of the pawls 81c of the top 81 is inserted into the cutout 95a defined to the cylindrical holding member 95 and the other pawl 81c is caused to go beyond the projection on the upper end of the holding member 95b by the deformation thereof so that the top 81 is gripped by the pressure of the holding piece 95b.

Figure 17:
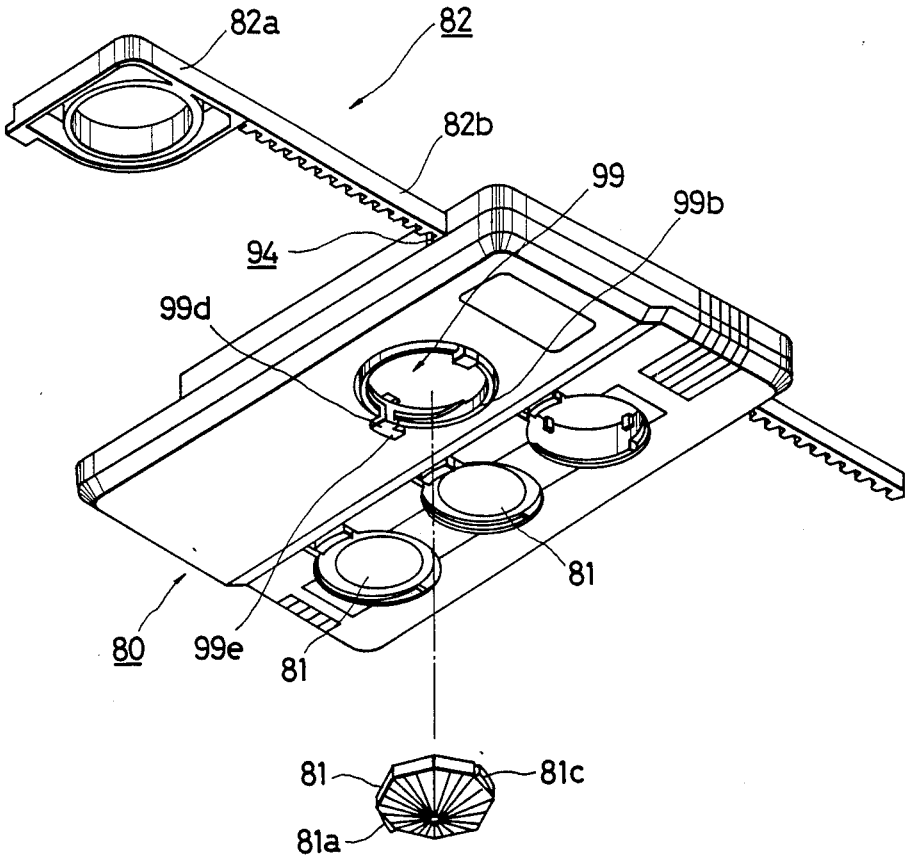
FIG. 17 is a perspective view of a state of the card case with a power rack inserted therethrough observed from the lower side.

Therefore, even if the card case 80 is upset as shown in FIG. 17, the top 81 does not fall due to the projection of the holding piece 95b.

The top 81 may be removed by being pushed out by a finger inserted into the round hole from the rear side.

As shown in FIG. 17, the removed top 81 is gripped by the grip portion 99b of the rotary member 99 engaged with the round hole 87 of the upper case 83 with its conical portion 81a directed upwardly.

At the time, the stopper 99e of the grip portion 99b is pressed by a finger and fixed to prevent the rotation of the grip portion 99b so that when the pawls 81c disposed on the outer circumference of the octagonal column portion 81b of the top 81 is dislocated to be set to the pawls 99d of the grip portion 99b and the top 81 is turned relative to the grip portion 899b, the pawls 81c of the top 81c are engaged with the pawls 99d of the grip portion 99b, whereby the top 81 is gripped by the grip portion 99b.

Then, when the rack belt 82b of the power rack 82 is inserted into the cutout 94 defined to the prescribed side wall 90 of the lower case 88 as shown in FIG. 17, the rack belt 82b is inserted along the second guide wall 93 and comes out from the cutout 94 on the other side after the teeth of the rack has been meshed with the pinion gear 98a of the rotary member 98.

Like the aforesaid embodiment, since the teeth of the rack belt 82b of the power rack are arranged nearer to a side edge on one side and the cutout 94 is of an L-shape, the rack belt 82b cannot be inserted unless it is inserted from the prescribed direction shown in FIG. 17 and with a prescribed posture.

When the card case 80 is upset in the state that the rack belt 82b is inserted into the card case 80 until a holding portion 82a reaches the vicinity of it, the card case 80 is held by one hand and the power rack 82 is pulled out vigorously by another hand, the grip portion 99b is rotated at a high speed by the engagement of the rack belt 82b with the pinion gear 98a and the engagement of the gear 98b with the gear 99a so that the top 81 gripped by the grip portion 99b is integrally rotated.

When a relative location in rotation of the grip portion 99b and the top 81 is dislocated, the engagement of the pawls 99d with the pawls 81c of them are released and the top 81 falls while it rotates.

As described above, the operation is very simple and anyone can spin the top 81 easily.

Next, a fourth embodiment will be described with reference to FIGS. 18–22.

This embodiment provides a toy automobile unit comprising a toy automobile as a movable toy. A card case 110 as large as that of the aforesaid embodiment accommodates a toy automobile 111 and four toy drums 112.

Figure 18:
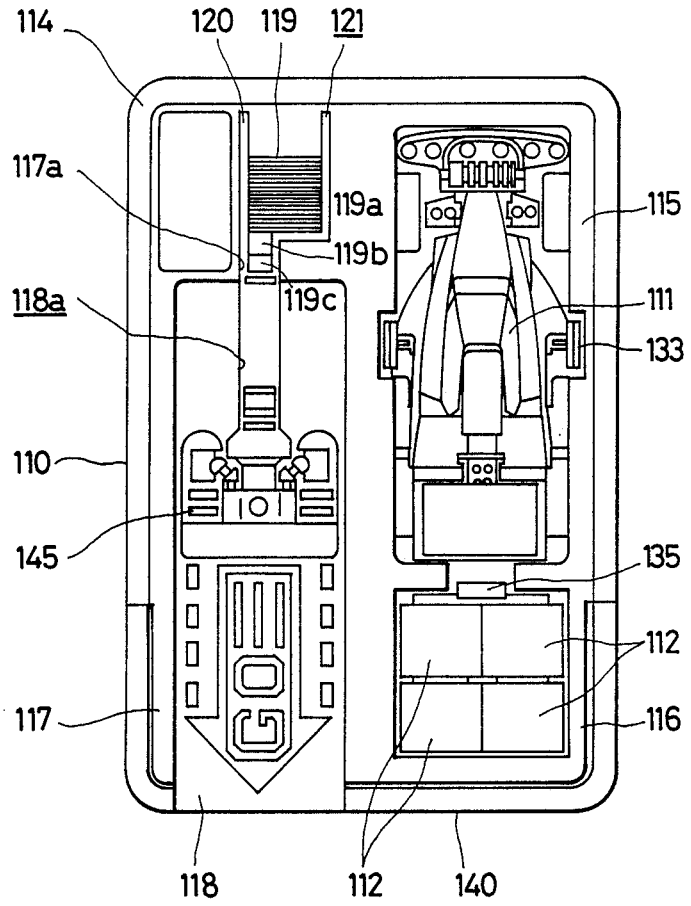
FIG. 18 is an overall plan view of a toy automobile unit of a fourth embodiment.

FIG. 18 is a plan view illustrative of the state they are accommodated in the case, wherein the toy automobile 111 is accommodated at the right upper area and the toy drums 112 are accommodated in two rows of each two drums piled vertically below the toy automobile 111.

A starting passage is formed on the left side of them.

The construction of the card case 110 will be described with reference to FIG. 19.

The card case 110 comprises an upper case 113 and a lower case 125. The upper case 113 includes long rectangular frame members 115 and short rectangular frame members 116 formed at a location nearer to one of a U-shaped side edge section 114 in the side edge section 114. A plate member 118 serving as the start passage is formed between the other of the side edge section 114 and the frame members 115, 116 and is interposed between a U-shaped frame member 117. A start button 119 is disposed behind the plate member 118.

The short rectangular frame member 116, the frame member 117 and the plate member 118 project ahead of the U-shaped side edge section 114 and the plate member 118 projects further ahead of the frame member 117.

The rectangular frame member 115 has confronting cutouts **115*a* defined on their long side walls and a restricted portion 116*a* is defined in a frame member interposed between the rectangular frame member 115 and the rectangular frame member 116**.

A lengthy long hole **118*a* is defined through the plate member 118 from the rear of the frame member 117 to the front thereof. A portion of the frame member 117 where the long hole 118*a* is in contact with the frame member 117 is lacked. One of the edge portions of the long hole 118*a* is extended from a lacked portion 117*a* to the side edge section 114 behind it to form a cutout 120. The other side edge of the long hole 11*a* bends at the lacked portion 117*a* at right angles and then it is connected to a cutout 121 bending at right angles in the direction of the rear side edge section 114 (refer to FIG. 18). The start button 119 is formed by the two cutouts 120, 121** between them.

Figure 20:
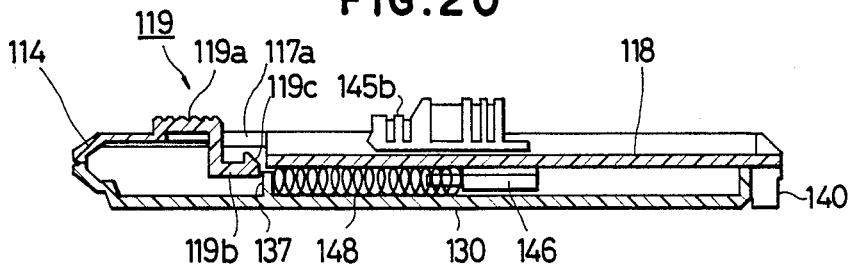
FIG. 20 is a cross-sectional view of the card case.

As shown in FIG. 20, the rear of the start button 119 is formed into a plate-shaped section integral with the side edge section 114. The front of the section is stepped and has a plurality of projections **119*a*** defined thereon.

The start button 119 has a projected section **119*b* projecting forwardly from the lower portion of the projections 119*a* and positioned between the lacked portion 117*a*, and the projected section 119*b* is a pawl 119*c*** projecting upwardly at its extreme end.

Next, the lower case 125 will be described. The lower case 125 also has a U-shaped side edge section 126, a long rectangular frame member 127 and a short rectangular frame member 128 in correspondence with the side edge section 114, the rectangular frame members 115, 116 of the upper case 113. The lower case 113 also has a pair of projections. The respective frame members 127, 128 and a pair of projections 129 have a bottom wall 130.

The bottom wall 130 extends to the long rectangular frame member 127 and has a large round hole defined at its center, rectangular holes 132 defined at its four corners and a pair of holding pieces 133 standing at locations corresponding to the cutouts **115*a* of the rectangular frame member 115 of the aforesaid case 113. Pawls 133*a* are formed on the confronting surfaces on the upper edge portions of the holding pieces 133**.

The bottom wall 130 extending to the short rectangular frame member 128 has a large rectangular hole defined 134 at its center. A part corresponding to the lacked portion **116*a*of the frame 116 of the upper case 113 is also lacked and a holding piece 135 stands on the bottom wall 130 thereunder. The holding piece 135 has a pawl 135*a*** projecting forwardly from its upper edge portion.

Two projections 136 are disposed on the bottom wall 130 extend between the projection 129 along the long hole **118*a* formed in the plate member 118 of the upper case 113 and a receiving member 137** stands at a prescribed location behind them.

A U-shaped leg member 140 is such that it is engaged with a portion projecting forwardly from the U-shaped side edge sections 114, 126 of the upper and lower cases 113, 125 to grip the portion. Semicircular cutouts 138, 139 are defined at corresponding locations of the respective outside portions of the rectangular frame members 116, 117 of the upper case 113, and the respective outside portions of the frame member 128 and the projection 129 of the lower case 125. The semicircular cutouts 138, 139 form round holes when the upper case 113 is placed over the lower case 125.

Protrusions 141 projecting from confronting surfaces of the opposite side edges of the leg member 140 are engaged with the round holes to permit the leg member 140 to swing about the protrusions 141.

A recess 142 is defined in the leg member 140 to support the extreme end of the plate member 118 projecting forwardly from the lower side.

As shown in FIG. 18, aligning the opposite sides of the leg member 140 with the directions extending from the side edge sections 114, 126 forms a rectangular side edge section of the card case 110 composed of the side edge sections 114, 126 and the leg member 140.

Figure 22:
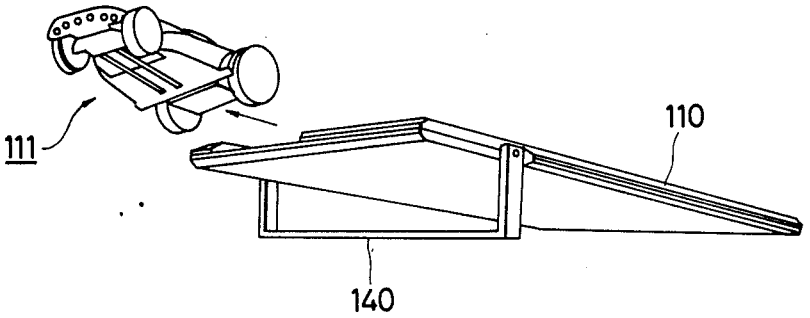
FIG. 22 is a perspective view illustrative of a state of the toy automobile springing out from the card case with a standing leg member.
Figure 23:
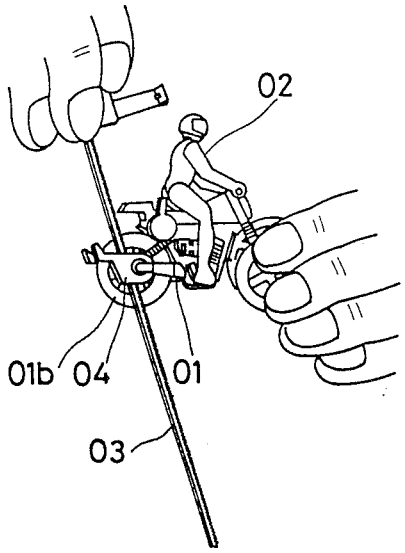
FIG.23 PRIOR ART
FIG. 23 is a perspective view of a toy bicycle of the prior art.

When the leg member 140 is swung downwardly from the state, it serves as a leg for supporting the card case 110 as shown in FIG. 22 so that the card case 110 is placed on a floor in an inclined state.

A push member 145 is engaged between the frame member 117 of the upper case 113 and a projection **145*a* disposed on the lower surface of the push member 154 is engaged with the long hole 118*a*** to be supported slidingly forwardly and backwardly.

A spring receiving member 146 is disposed below the push member 145 though the plate member 118, a projection **146*a* disposed on the lower surface of the spring receiving member 146 is slidingly engaged between a pair of the projections 136 and the upper push member 145 is integrally threadably attached to the lower spring receiving member 146 by a screw 147**.

Therefore, the push member 145 and the spring receiving member 146 are formed integrally through the plate member 118 and the projection **145*a* passing through the long hole 118*a*** and capable of sliding forwardly and backwardly.

The spring receiving member 146 has a protrusion **146*b* disposed on its rear surface and a coil-shaped push spring to be inserted into the protrusion 146*b* is interposed between the receiving member 137 and the rear surface of the spring receiving member 146**.

Figure 21:
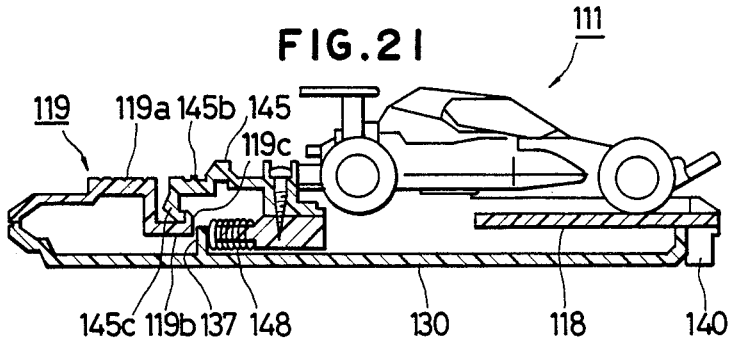
FIG. 21 is a side view illustrative of a state of the card case with the toy automobile placed on it, partly in cross section.

The push member 145 has a protrusion **145*b* projecting backwardly from the center of its rear surface and the protrusion 145*b* has a pawl 145*c* formed downwardly on its rear end as shown in FIG. 21**.

The card case 110 is assembled by combining the respective members. Since the lower case 125 has round holes 150 defined at five locations along the side edge section 126 and the upper case 113 has non-illustrated screw holes defined in correspondence to the round holes 150, they are threadably attached by screws 151.

More particularly, first the push member 145 is integrally secured to the spring receiving member 146 through the long hole **118*a* by the screw 147, the push spring 148** is placed between a pair of the projections 136 of the lower case 125 as well as the protrusions 141 of the leg member 140 are engaged with the semicircular cutouts 139 defined in the forward outside frame, and then the upper case 113 is placed over the lower case 125 from the upper side.

The arrangement is such that the protrusion 146*b* at the rear of the spring receiving member 146 is inserted into the front end of the push spring 148 so that the push spring 148 is interposed between the receiving member 137 and the spring receiving member 146.

Thus, the screws 151 are inserted into the round holes from the lower side to be threaded with the screw holes of the upper case 113 to assemble the card case 110.

The push member 145 is capable of sliding backwardly against the push spring 148 as shown in FIG. 21 and the leg member 140 is capable of swinging about the protrusions 141 from the front downwardly at right angles as shown in FIG. 22.

As shown in FIGS. 18 and 21, the toy automobile 111 is a four-wheel car for racing and has wheels rotated freely.

When the toy automobile 111 is set in the rectangular frame member 115 and the wheels thereof are fitted to the rectangular holes 132 as shown in FIG. 18, the holding pieces 133 at the right hand and left sides grip a car body and the pawls 133*a* lock the toy automobile 111.

Figure 19:
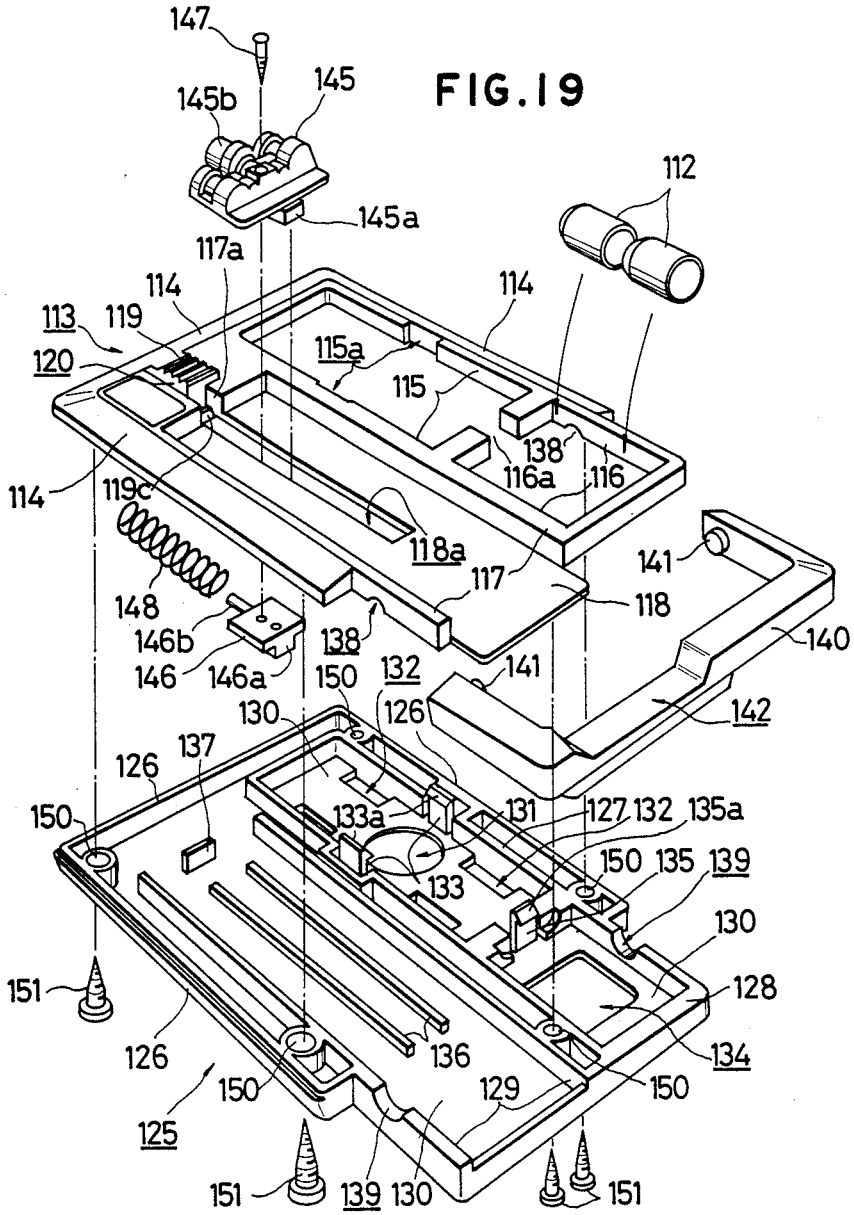
FIG. 19 is an exploded perspective view of a card case of the toy automobile unit.

Each of the two cylindrical toy drums 112 are piled vertically and are accommodated in the rectangular frame member 116 in parallel and locked by the holding piece 135 as shown in FIG. 19.

When the leg member 140 is directed horizontally, the card case 110 makes a card shape as a hole as shown in FIG. 1. Even if the card case 110 is upset, the toy automobile 111 and the toy drums 112 do not fall because they are secured, thus the card case 110 is convenient for carrying.

When a game is played, a finger is applied to the round hole 131 on the back of the toy automobile 111 to push it out and further the toy drums can be pushed out by a finger applied to the rectangular hole 134.

When the push member 145 is pushed in backwardly against the push spring 148, the pawl 145*c* at the rear of the push member 145 is held in abutment against the pawl 119*c* of the start button 119 so that both the pawls are engaged to lock the push member 145 at the location as shown in FIG. 21.

After that, the toy automobile 111 is placed on the plate member 118 such that a rear bumper of the toy automobile 111 is held in abutment against the push member 145.

Thus, the preparation for traveling is completed.

When the card case 110 is place on a floor as it is or it is placed on it with the leg member 140 standing downwardly at right angles to provide an inclination with the starting passage and the projections 119*a* of the start button 119 is depressed, the pawl 119*c* moves downwardly to release its engagement with the pawl 145*c* so that the push member 145 is projected forwardly by the force of the push spring 148.

As a result, the toy automobile 111 can be sprung out by being pushed by the push member 145.

It is possible to enjoy such games as crushing the toy drums 112 piled up forwardly by starting the toy automobile and aiming at them or the like.

Since the toy automobile 11 is started by the depression of the start button 119 provided with the card case 110 in the state that the toy automobile 111 is placed in the card case 110, no unnatural force is applied to the toy automobile 111 and the only effective force is applied to it so that the toy automobile 111 can start stably at all times.

According to the present invention, since power is applied to a movable toy in the state that it is supported in a toy case, the toy can make stable movement at all times and no unnatural force is applied to the movable toy itself so that there is no possibility that the movable toy is damaged.

Since the movable toy starts movement from the state where it is supported by a support means of a toy case, it can move stable at all times, anyone can handle the toy easily and it is not necessary to learn how to operate it for playing a game.

Since the movable toy is engaged with a toy case to be made in the form of a card shape as a whole, it fits in a user's palm and is very convenient for carrying.

Since the movable toy is engaged with the toy case to be protected securely when it is carried, the movable toy is prevented from being damaged when it strikes against an object or it is dropped. In addition, since there is no projection on the card case, it is not damaged by being caught by an object.

I claim:

1. An improved storage container for a manually propelled toy member comprising:

a thin flat housing member configured to be of a size approximating the user's hand, the housing member having a cavity for retainably storing the toy member, and means in the housing member, at a position apart from the cavity, for transmitting a propulsion force to the toy member including a removable flexible power rack.

2. The storage container of claim 1 further including an internal curved channel for guiding the movement of the power rack member.

3. The storage container of claim 2 wherein the housing member has an approximate dimension of 6 cm wide, 9 cm long and 1.2 cm thick.

4. In an improved toy assembly having at least one manually propelled toy member, the improvement comprising:

an elongated approximately rectangular housing forming the case member and having a relatively small thickness compared to its width and length and configured to be of a size smaller than a hand of the user, the housing having a cavity of a configuration to receive and retain the toy member within approximately the thickness of the housing and the toy member is configured to accommodate the cavity thickness; means for operatively mounting the toy member for propulsion on the housing, and means for propelling the toy member including a rack and pinion gear system.

5. In an improved toy assembly having at least one manually propelled toy member and a case member for removably storing the toy member, the improvement comprising:

an elongated approximately rectangular housing forming the case member and having a relatively small thickness compared to its width and length and configured to be of a size smaller than a hand of the user, the housing having a cavity of a configuration to receive and retain the toy member within approximately the thickness of the housing and the toy member is configured to accommodate the cavity thickness; means for operatively mounting the toy member for propulsion on the housing, and means for propelling the toy member, the toy member having a structural component that can move to reduce the exterior thickness of the toy member for storage purposes in the case member.

6. The toy assembly of claim 5 wherein the toy member is configured to simulate a motorcycle, the motorcycle having a set of handlebars mounted for movement towards each other to provide a collapsed storage position for mounting in the cavity.

7. A toy unit comprising:

a movable toy;

a thick card-shaped toy case having a cavity of a dimensional shape of approximately the dimension of the toy member and an engaging section for detachably accommodating said movable toy, and support means for supporting and releasing said movable toy when said movable toy starts movement, and power generating means including a rack means detachably accommodated in said toy case for applying power to said movable toy, respectively.

8. A toy unit according to claim 7 wherein said rack means comprises a holding portion and a long rack belt contiguous to said holding portion.

9. In an improved toy assembly having at least one manually propelled toy member and a case member for removably storing the toy member, the improvement comprising:

an elongated approximately rectangular housing forming the case member and having a relatively small thickness compared to its width and length and configured to be of a size smaller than a hand of the user, the housing having a cavity of a configuration to receive and retain the toy member within approximately the thickness of the housing and the toy member is configured to accommodate the cavity thickness, means for detachably retaining the toy member, means for operatively mounting the toy member for propulsion on the housing, and means for propelling the toy member with a subsequent release by the detaching means to permit the toy member to be propelled away from the case member including a rack and pinion gear system.

10. The toy assembly of claim 9 wherein the toy member has a structural component that can move to reduce the exterior thickness of the toy member for storage purposes in the case member.

11. The toy assembly of claim 10 wherein the toy member is configured to simulate a helicopter, the helicopter having a set of rotor blades mounted for movement to be positioned across each other during storage in the cavity.

* * * * *